US009157265B2

(12) United States Patent
Pelekanos

(10) Patent No.: US 9,157,265 B2
(45) **Date of Patent: *Oct. 13, 2015**

(54) BOGEY

(71) Applicant: RMD Industries Pty Ltd, Regents Park, NSW (AU)

(72) Inventor: Stylianos Pelekanos, Regents Park (AU)

(73) Assignee: RMD Industries Pty Ltd, Regents Park, NSW (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/177,724

(22) Filed: Feb. 11, 2014

(65) Prior Publication Data

US 2014/0251555 A1 Sep. 11, 2014

Related U.S. Application Data

(63) Continuation of application No. 13/626,427, filed on Sep. 25, 2012, now Pat. No. 8,695,165, which is a continuation-in-part of application No. 13/388,252, filed as application No. PCT/AU2010/000963 on Jul. 29, 2010, now Pat. No. 8,677,564.

(30) Foreign Application Priority Data

| | | |
|---|---|---|
| Jul. 31, 2009 | (AU) | 2009903608 |
| Dec. 23, 2009 | (AU) | 2009251170 |
| Dec. 23, 2009 | (AU) | 2009906264 |
| Feb. 29, 2012 | (AU) | 2012201223 |

(51) Int. Cl.

| | |
|---|---|
| ***E05D 15/16*** | (2006.01) |
| ***E05D 15/26*** | (2006.01) |
| ***E05D 15/06*** | (2006.01) |

(52) U.S. Cl.
CPC ..... *E05D 15/26* (2013.01); *E05D 15/063* (2013.01); *E05D 15/0634* (2013.01);
(Continued)

(58) Field of Classification Search
USPC ..... 16/90, 91, 94 R, 96 R, 95 R, 97, 16/101–107, 87 R, 84 R, 87.6 R, 87.8, 273; 160/185, 199; 49/404, 409, 410, 411, 49/412, 420, 421–425, 453, 455
See application file for complete search history.

(56) References Cited

U.S. PATENT DOCUMENTS

| | | | | |
|---|---|---|---|---|
| 1,420,087 | A * | 6/1922 | Frantz | 160/199 |
| 2,761,172 | A * | 9/1956 | Jorgensen et al. | 16/105 |

(Continued)

FOREIGN PATENT DOCUMENTS

| | | | |
|---|---|---|---|
| AU | 199947374 | B2 | 3/2000 |
| CH | 691073 | A5 | 4/2001 |

(Continued)

OTHER PUBLICATIONS

European Search Report corresponding to EP10803741.7.

(Continued)

*Primary Examiner* — Chuck Mah
(74) *Attorney, Agent, or Firm* — Kilpatrick Townsend & Stockton LLP

(57) ABSTRACT

A bogey includes a body having only a single set of support wheels, with one wheel positioned either side of the body. A threaded retainer is arranged for threaded engagement with a shaft of a hanger bolt. The retainer is located in spaced relation from the wheels, whereby the bolt is cantilevered from the body.

12 Claims, 22 Drawing Sheets

(52) U.S. Cl.
CPC ..... *E05Y 2600/528* (2013.01); *E05Y 2600/60* (2013.01); *Y10T 16/35* (2015.01); *Y10T 16/364* (2015.01); *Y10T 16/381* (2015.01); *Y10T 16/3813* (2015.01); *Y10T 16/3834* (2015.01); *Y10T 16/3837* (2015.01)

(56) References Cited

U.S. PATENT DOCUMENTS

| | | | | | |
|---|---|---|---|---|---|
| 2,957,197 | A | * | 10/1960 | Johnson, Jr. | 16/105 |
| 3,757,384 | A | * | 9/1973 | Rusch | 16/97 |
| 3,829,929 | A | * | 8/1974 | Foltz et al. | 16/97 |
| 4,750,237 | A | * | 6/1988 | Johnston | 16/102 |
| 5,035,025 | A | * | 7/1991 | Morris et al. | 16/97 |
| 6,209,171 | B1 | | 4/2001 | Pelletier et al. | |
| 6,463,625 | B2 | * | 10/2002 | Mittag | 16/97 |
| 6,983,512 | B2 | * | 1/2006 | De Oliveira | 16/97 |
| 7,117,559 | B1 | * | 10/2006 | Barber | 16/97 |
| 2002/0162190 | A1 | | 11/2002 | Spork et al. | |
| 2010/0205772 | A1 | * | 8/2010 | Haab et al. | 16/91 |

FOREIGN PATENT DOCUMENTS

| | | | | |
|---|---|---|---|---|
| EP | 1013864 | A1 | | 6/2000 |
| EP | 2009133060 | A | | 6/2009 |
| EP | 1674643 | A3 | | 3/2012 |
| GB | 659625 | | | 2/1950 |
| GB | 1405931 | | | 9/1975 |
| JP | 2007315106 | A | * | 12/2007 |
| JP | 2009133060 | A | * | 6/2009 |

OTHER PUBLICATIONS

European Search Report corresponding to EP12187697.3.

* cited by examiner

BOGEY

RELATED APPLICATIONS

This application claims the benefit of priority from U.S. patent application Ser. Nos. 13/626,427, 13/388,252, International Patent Application No. PCT/AU2010/000963, Australian Patent Application No. 2009903608, Australian Patent Application No. 2009906264 and Australian Patent Application No. 2009251170, the contents of which are incorporated by reference.

FIELD OF THE INVENTION

The present invention relates to a bogey particularly but not exclusively for carrying a hanger bolt for supporting a folding panel such as a door panel.

SUMMARY OF THE INVENTION

In accordance with the invention, there is provided a bogey with a body having only a single set of support wheels, with one wheel positioned either side of the body, and a threaded retainer arranged for threaded engagement with a shaft of a hanger bolt, wherein the retainer is located in spaced relation from the wheels, whereby the bolt is cantilevered from the body.

Preferably, the retainer is positioned internally of the body.

Preferably, the bogey further includes a lock mechanism to engage side flats of the bolt, to restrict axial movement of the bolt resulting from relative rotation between the bolt and the retainer.

Preferably, the lock mechanism includes a keeper that slides into an engaged position to lock the bolt against rotation.

Preferably, the lock mechanism includes a collar that is fitted to the flats of the bolt and the keeper engages and locks against the collar to restrict relative rotation of the bolt.

Preferably, the collar includes a slotted profile, in to which the keeper is moved to engage and lock the collar and bolt against rotation.

Preferably, the keeper is retained in an engaged position under bias.

Preferably, the lock mechanism includes an actuator button to move the keeper between a free position and the engaged position.

Preferably, the lock mechanism has a cover plate to capture the keeper in a housing in a base of the body and the button projects through the plate.

The bogey is preferably provided in combination with the threaded hanger bolt that is screw threaded into the retainer, the bolt having side flats for the lock mechanism to engage, to restrict relative rotation between the bolt and the retainer.

In another aspect, there is provided a panel assembly including the bogey, as described above, an end panel supported by the bogey and a hanger bolt interconnecting the end panel and the bogey.

In another aspect, there is provided a folding door system, including a frame with a jamb and an overhead track, a folding panel assembly mounted in the frame and the bogey, as described above, wherein an end panel of the folding panel assembly is mounted to the overhead track via the bogey and an interconnecting hanger bolt.

Preferably, the bogey travels above the panel through the track as the panel is opened and closed and wherein the body of the bogey holds the hanger bolt in a cantilevered position adjacent the jamb when the panel is closed, while the supporting wheels are positioned in spaced relation from the jamb so as to enable an edge of the end panel to substantially close against the jamb without obstruction from the wheels.

BRIEF DESCRIPTION OF THE DRAWINGS

The invention is described in more detail, by way of non-limiting example only, with reference to the accompanying drawings, in which.

DETAILED DESCRIPTION OF THE DRAWINGS

Figure 1:
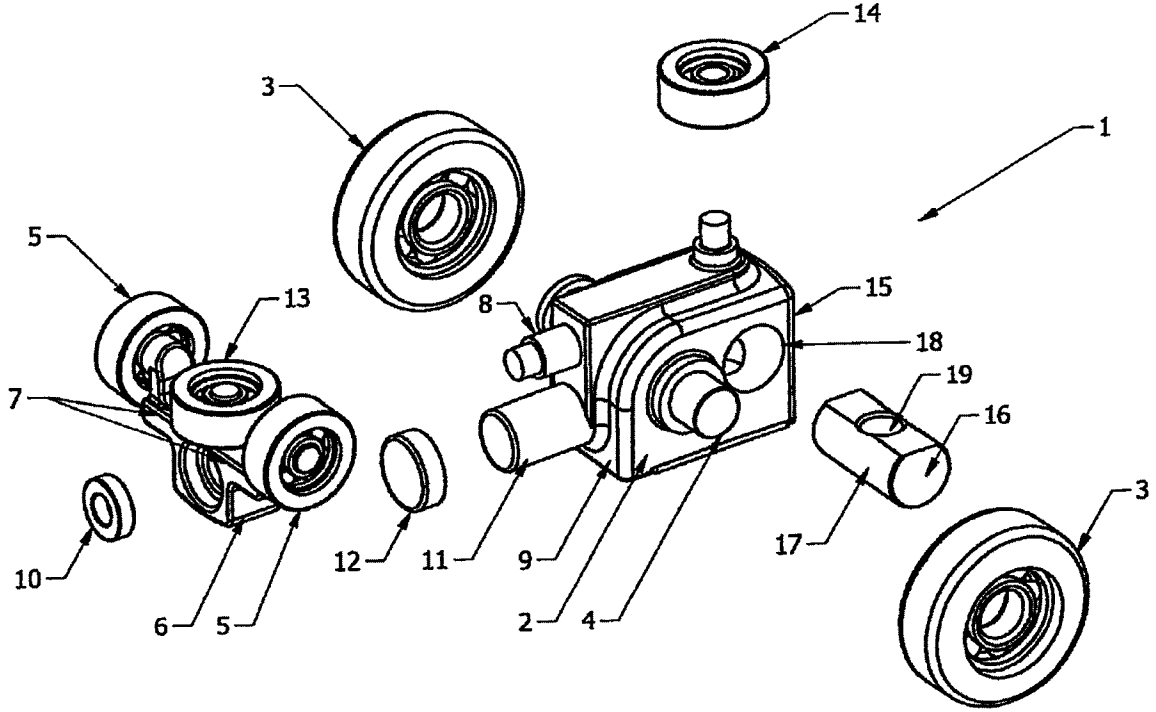
FIG. 1 is an exploded view of a bogey assembly.

Referring firstly to FIG. 1, a first example of a bogey assembly 1 is shown as including a body 2, two main wheels 3 mounted on respective axles 4 and two smaller rollers 5 carried by a pivot arm assembly 6.

The pivot arm assembly 6 is formed of two lateral sections 7 which extend from a central bearing, which is mounted to a pivot in the form of an axle 8 that projects from a first end 9 of the body 2. The assembly 6 is secured to the body 2 in place using a washer 10, which is riveted in place.

A boss 11 is provided on the body 2, beneath the pivot arm assembly 6 and is fitted with a rubber buffer 12. The boss 11 and buffer 12 serve as an end of travel stop for the bogey assembly 1.

The assembly 6 also has a top mounted guide roller 13, which is in alignment with a second guide roller 14 mounted toward a second end 15 of the body 2.

The second end 15 of the bogey assembly 1 also houses a retainer 16, which is in the form of a pivotal member or axle 17 that extends through a substantially horizontal passage 18 provided in the body 2, arranged transverse to a direction of travel of the bogey assembly 1.

Figure 2:
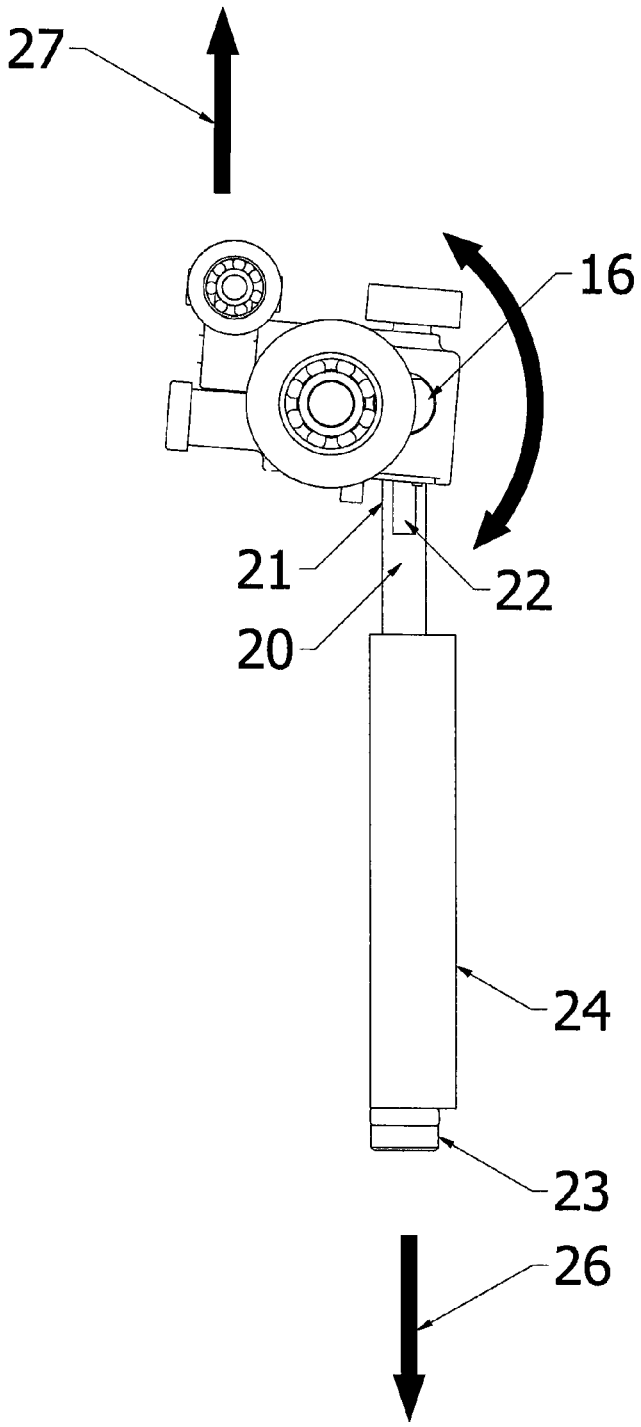
FIG. 2 is a side view of the bogey assembly with a hanger bolt.

The retainer 16 includes an internal thread 19 for threaded engagement with a hanger bolt 20, which is illustrated in FIG. 2.

The hanger bolt 20 is shown as including a threaded shaft 21 with side flats 22 and a bolt head 23, which supports a hinge 24. In order to mount the shaft in the bogey assembly 1, the threaded shaft 21 is engaged with the internal thread 19 and rotated into the retainer 16 until the hanger bolt 20 is at a desired height.

Once the hanger bolt 20 is mounted in the bogey assembly 1, the hanger bolt 20 can pivot about the retainer 16 in a direction indicated by arrows 25. This serves to substantially reduce moments that might have otherwise applied through the hanger bolt 20 if, for example, the hanger bolt 20 had a fixed connection with the bogey assembly 1.

Figure 3:
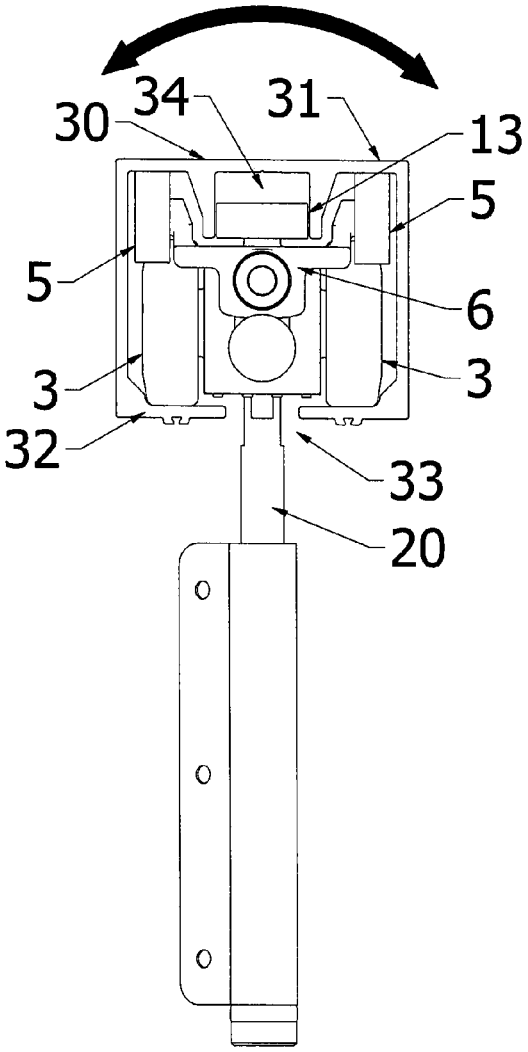
FIG. 3 is an end view of the bogey assembly in a track.
Figure 4:
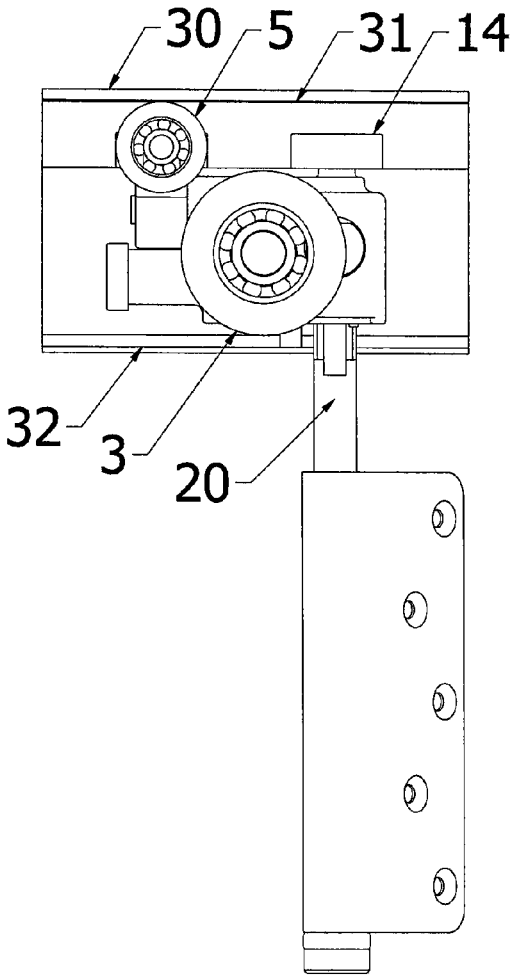
FIG. 4 is a diagrammatic side view of the bogey assembly in the track.

The positioning of the retainer 16 toward the second end 15 of the bogey assembly 1 also means any weight load force applied to the hanger bolt 20, such as from a supported door panel or the like (as indicated by arrow 26) is transferred to the rollers 5 through pivot action of the body 2 (as indicated by arrow 27) so that the rollers maintain contact with a track 30, as illustrated in FIGS. 3 and 4.

More particularly, FIGS. 3 and 4 show the track 30 as including a top rail section 30A and a lower rail section 30B with a slot 30C to allow passage of the hanger bolt 20 suspended from the bogey assembly 1. The top rail section 30A also includes a central channel 30D to receive the guiding rollers 13, 14.

As may be appreciated, any downward movement on the hanger bolt 20 will cause the main wheels 3 to firmly engage the lower rail section 30B but will also cause the rollers 5 to be loaded against the top rail section 30A via the pivot arm assembly 6. The hanger bolt 20 is able to pivot about the retainer 16 to maintain a generally vertical orientation.

The pivot arm assembly 6 and its associated axle 8 thereby represents a live axle of the bogey assembly 1 in the sense the pivot arm assembly 6 rotates about a substantially horizontal axis, oriented in a direction of travel of the bogey assembly 1, to ensure the rollers 5 split the load equally. On the contrary, the prior art fixed axle arrangement requires total precision to safeguard against uneven load distribution and wear.

A second live axle is provided by the retainer 16, which supports the hanger bolt 20. In that case, the axle 17 also compensates for inaccuracy in the bogey assembly 1. For example, if the rollers 5 are cast too low, the load down the hanger bolt 20 will not be perfectly perpendicular to the bogey assembly 1, which would normally create large bending moments in the hanger bolt 20 and possible fatigue and fracture. The live axle 17, however, compensates and automatically adjusts by allowing the retainer 16 to pivot so that the load passes through the hanger bolt 20 without bending. This will, of course, mean the hanger bolt 20 will move fractionally during use but any variation can be taken up by the height adjustment built into the design.

Pivotal movement of the hanger bolt 20 relative to the bogey assembly 1 does, however, present a problem in relation to locking the hanger bolt 20 at a selected height, to prevent the hanger bolt 20 unscrewing from the body 2 over time. A conventional lock-nut to lock the hanger bolt 20 to the body 2 is clearly inappropriate as the pivotal movement of the hanger bolt 20 would be restricted as a result. To address this problem, the bogey assembly 1 is provided with a lock mechanism 32, as shown in FIGS. 5 to 12.

Figure 5:
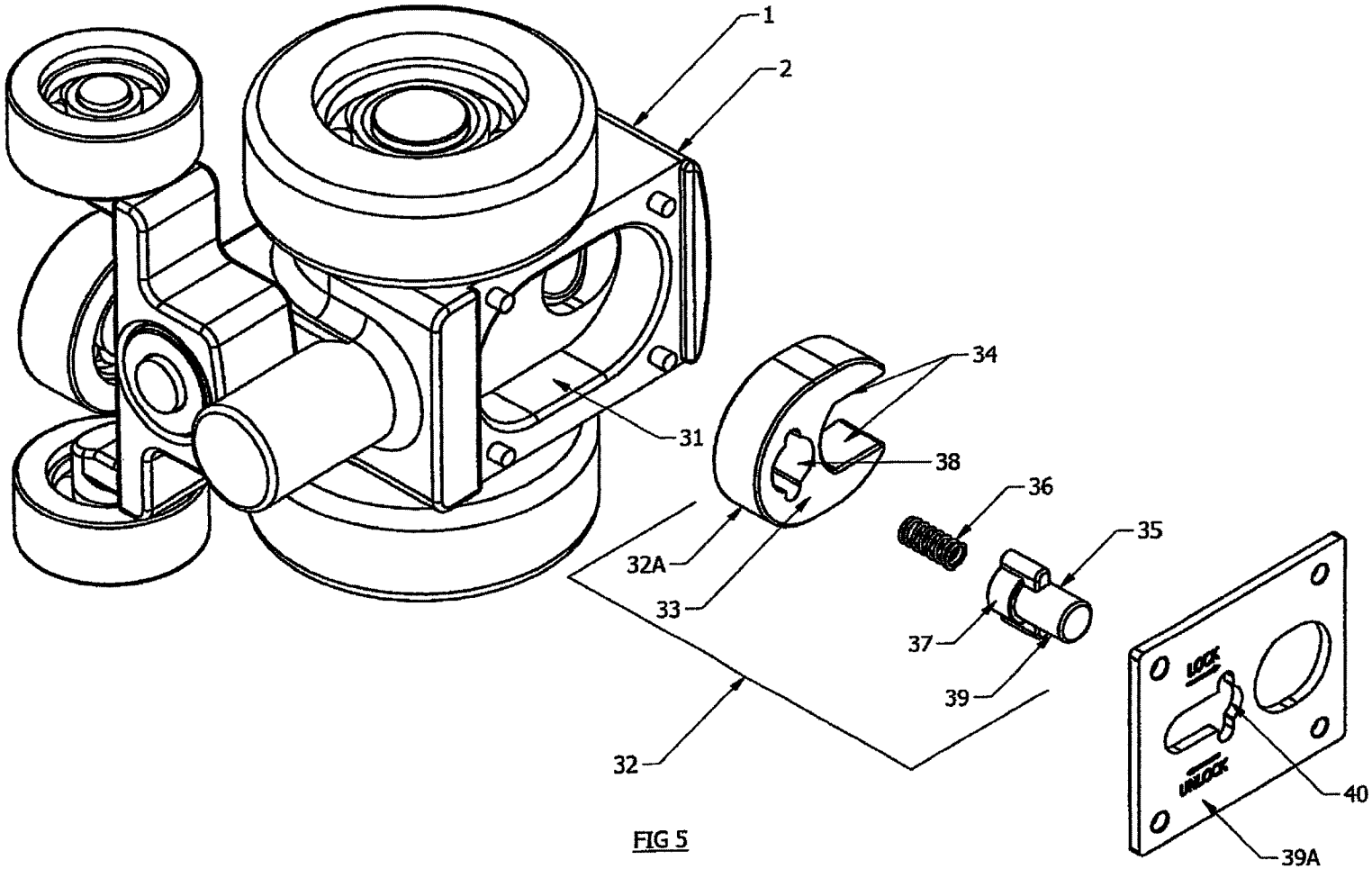
FIG. 5 is a perspective view of the bogey assembly with an exploded view of a lock mechanism.

Referring firstly to FIG. 5, the body 2 of the bogey assembly 1 is recessed to provide a housing 31 for the lock mechanism 32. The lock mechanism 32 is configured to be movable between a locked condition, where the hanger bolt 20 is restricted from rotation about its elongate axis, and an unlocked condition where the hanger bolt 20 may be rotated about its elongate axis. The lock mechanism 32 includes a keeper 32A which is arranged to move between an engaged and a free position, the engaged position providing the locked condition and the free position providing the unlocked condition.

The keeper 32A is formed as a U-shaped block 33, with flat surfaces 34 confined to fit with flats 22 of the hanger bolt 20. Accordingly, in the engaged condition the flat surfaces 34 of the U-shaped block 33 directly engage with the flats 22 of the hanger bolt 20. The U-shaped block 33 provides a slightly elongate housing for the hanger bolt 20 and as such when the keeper 32A is in the engaged position, the U-shaped block 33 restricts the hanger bolt 20 from rotation about its elongate axis but allows the hanger bolt 20 limited movement in the direction of travel of the bogey assembly 1 by pivoting about the retainer 16. During this pivoting it may be appreciated that there will be some limited sliding movement between the flats 22 of the hanger bolt 20 and the flat surfaces 34 of the U-shaped block 33.

The lock mechanism 32 also has an actuating button 35 which is biased by a spring 36 and which needs to be depressed in order to move the keeper 32A out of engagement with the hanger bolt 20. The button 35 has a base 37, received in a bore 38 of the block 33 and a neck 39 which passes through a guide slot, formed in cover plate 39A.

Figure 6:
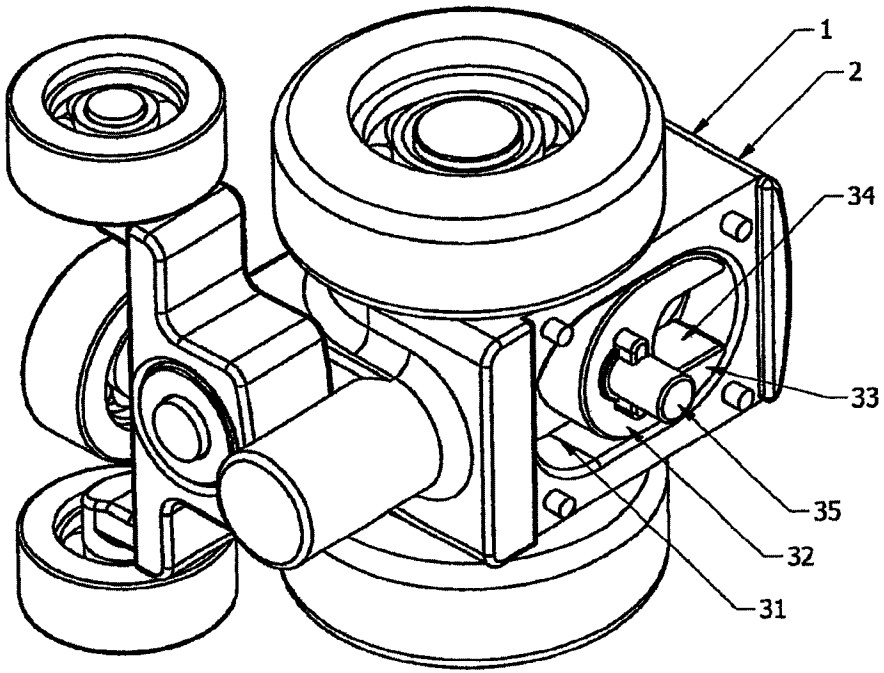
FIG. 6 is a perspective view of the lock mechanism housed within a body of the bogey.

When the keeper 32A is in the engaged position where the lock mechanism 32 is in the locked condition, as illustrated in FIG. 6, the button 35 is spring biased to project through an enlarged aperture 40 in the cover plate 39A.

Figure 7:
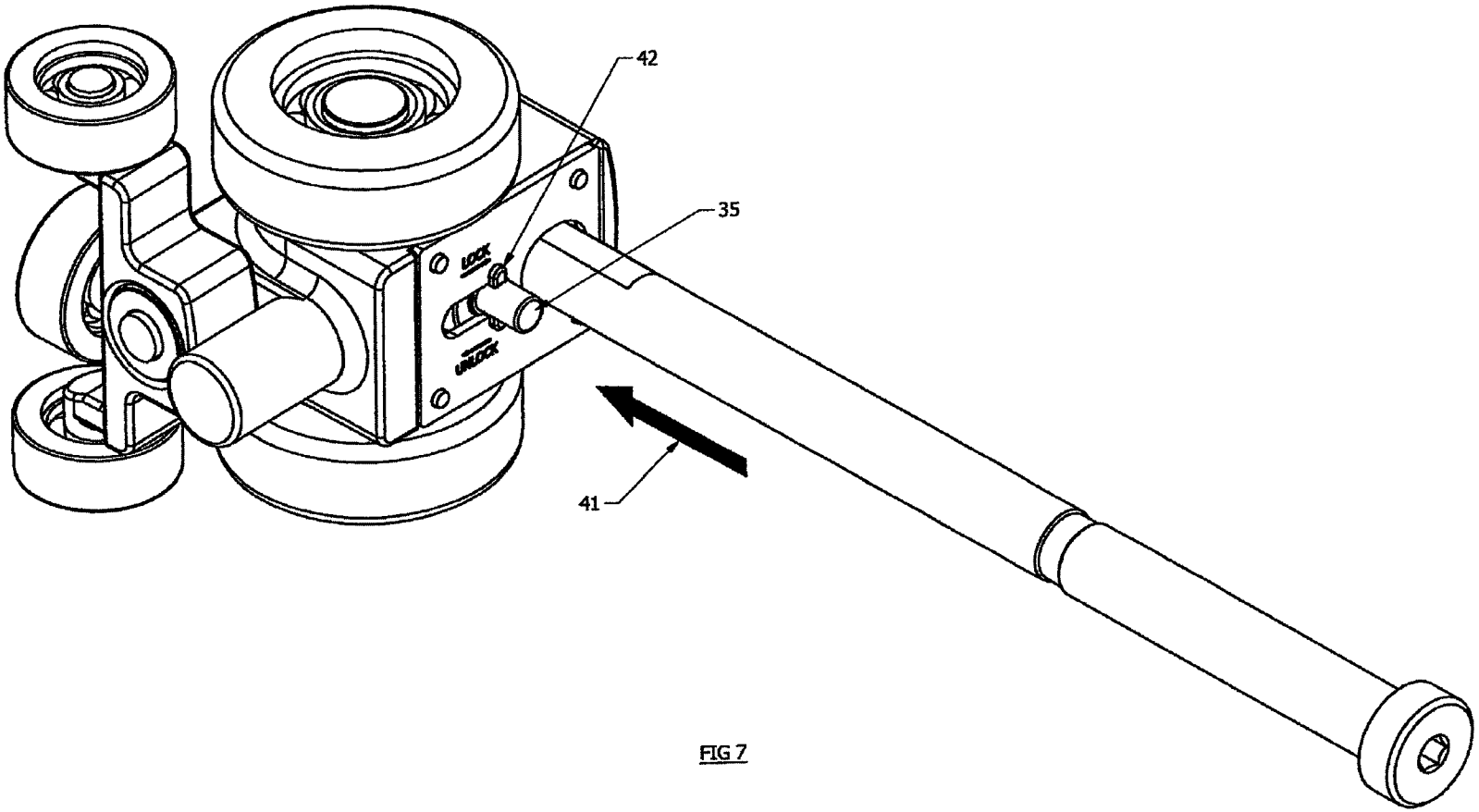
FIG. 7 is a perspective view of the bogey assembly and hanger bolt.
Figure 8:
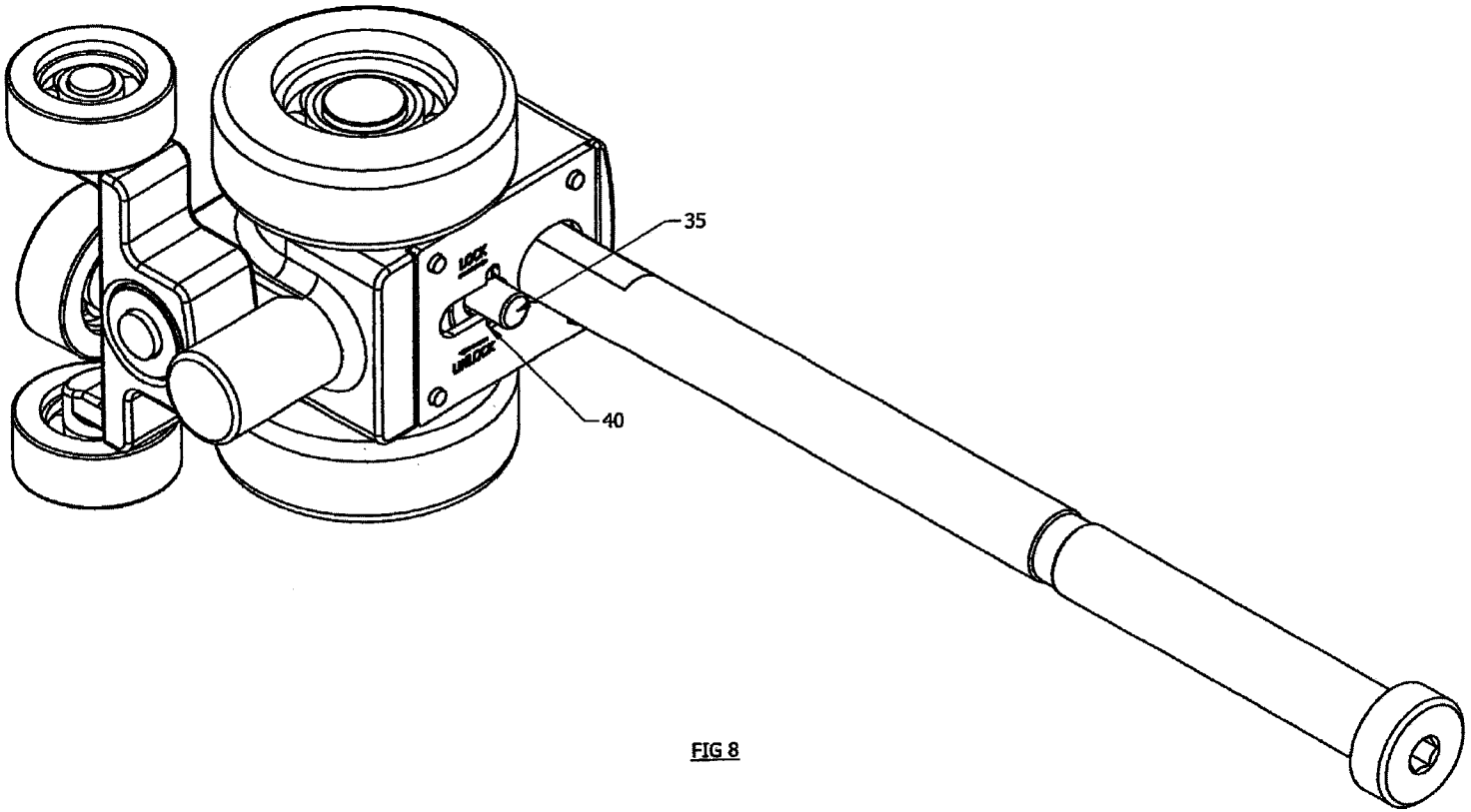
FIG. 8 illustrates the lock mechanism being freed for adjustment.

To release the lock mechanism 32, the button 35 needs to firstly be pressed in a direction indicated by arrow 41 in FIG. 7, until shoulders 42 of the button clear the aperture 40, as illustrated in FIG. 8.

Figure 9:
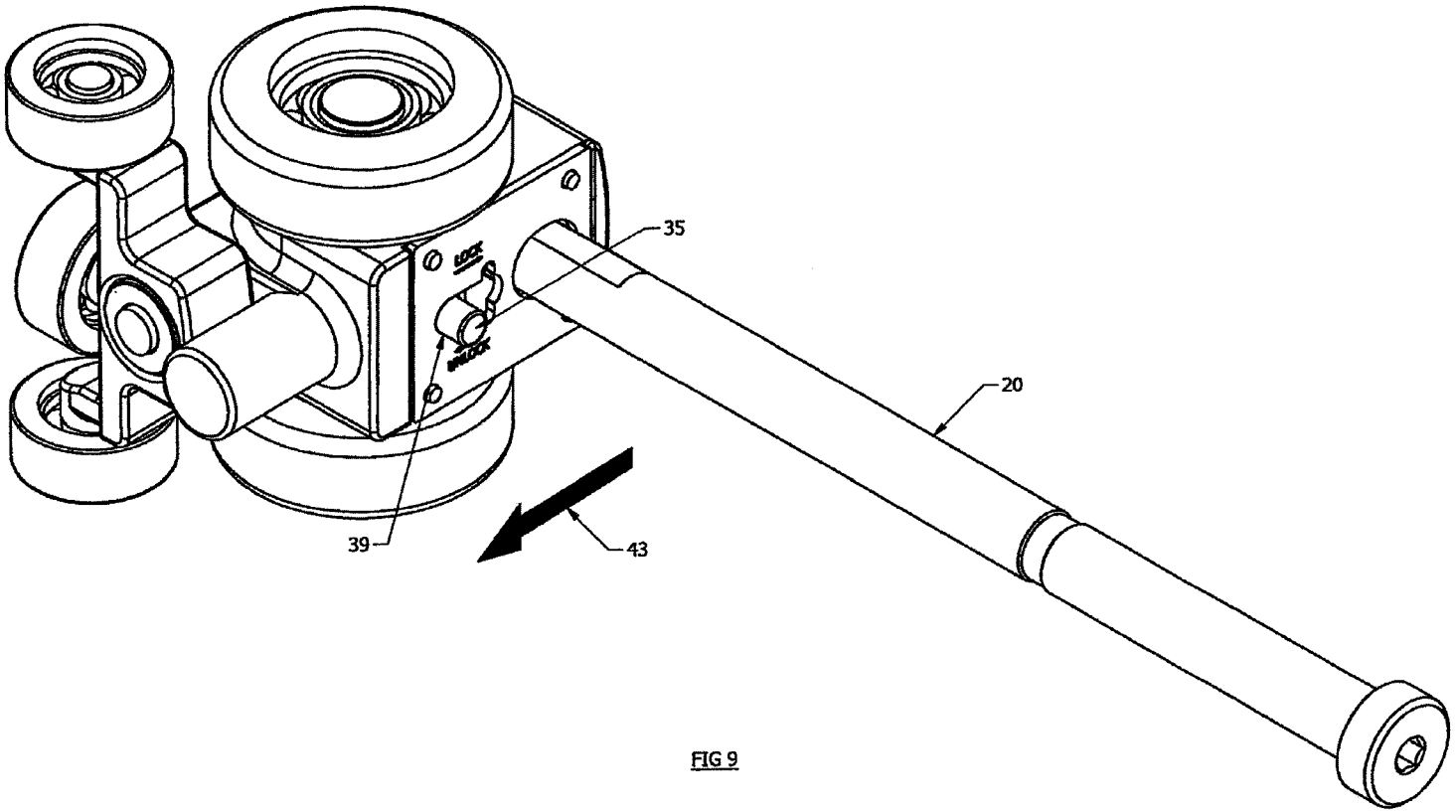
FIG. 9 illustrates the lock mechanism in an unlocked condition.

The button 35 is then slid in a direction indicated by arrow 43, as shown in FIG. 9, so that the neck 39 of the button 35 travels along the slot, which draws the keeper 32A out of engagement with the hanger bolt 20 so as to provide the free position where the lock mechanism 32 is in the unlocked condition.

Figure 10:
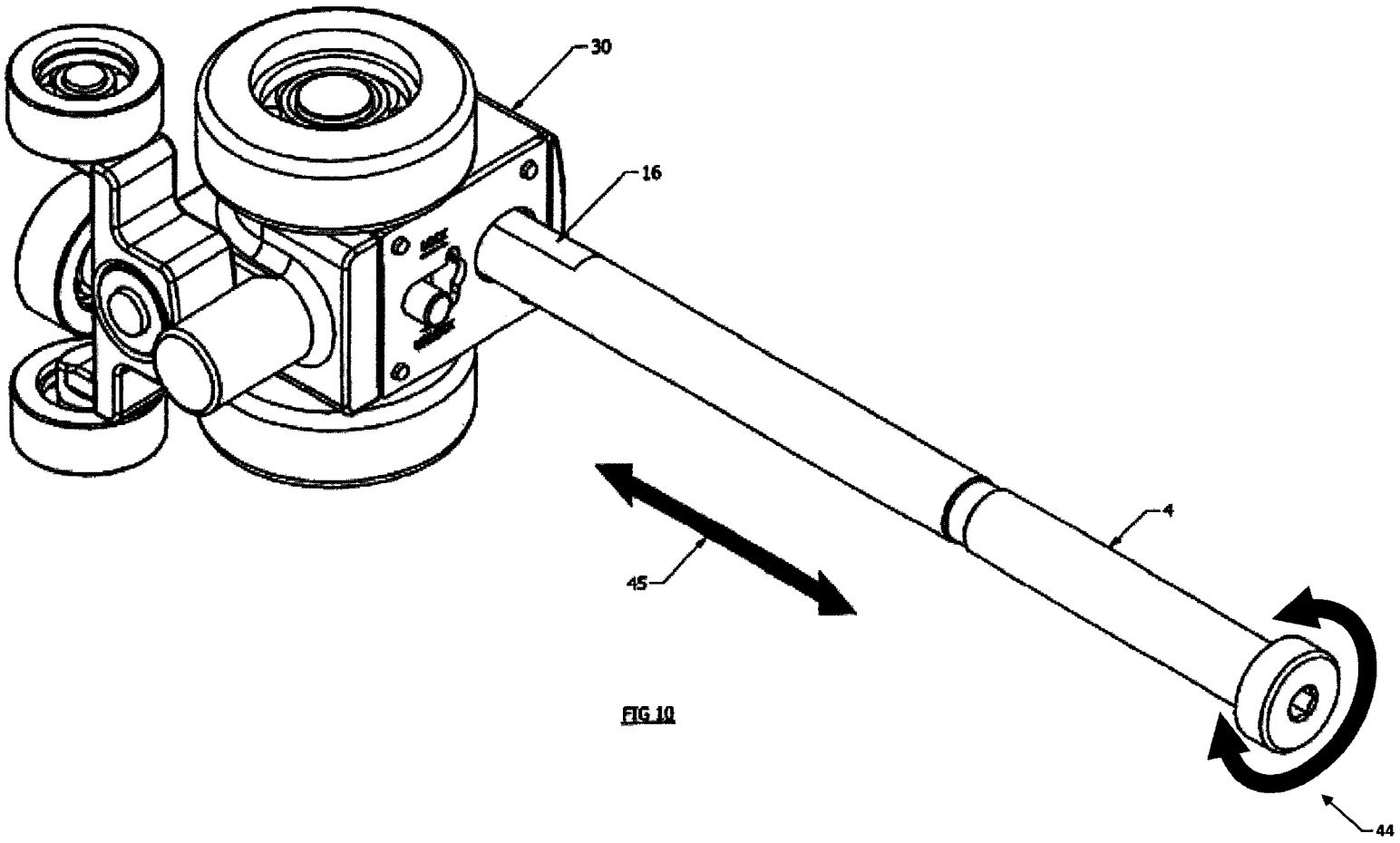
FIG. 10 illustrates adjustment of the hanger bolt.

The hanger bolt 20 may then be rotated in a direction indicated by arrows 44 in FIG. 10, to effect screw threaded axial movement in the directions indicated by arrows 45, into and out of the retainer 16 and hence the bogey assembly 1, as required.

Figure 11:
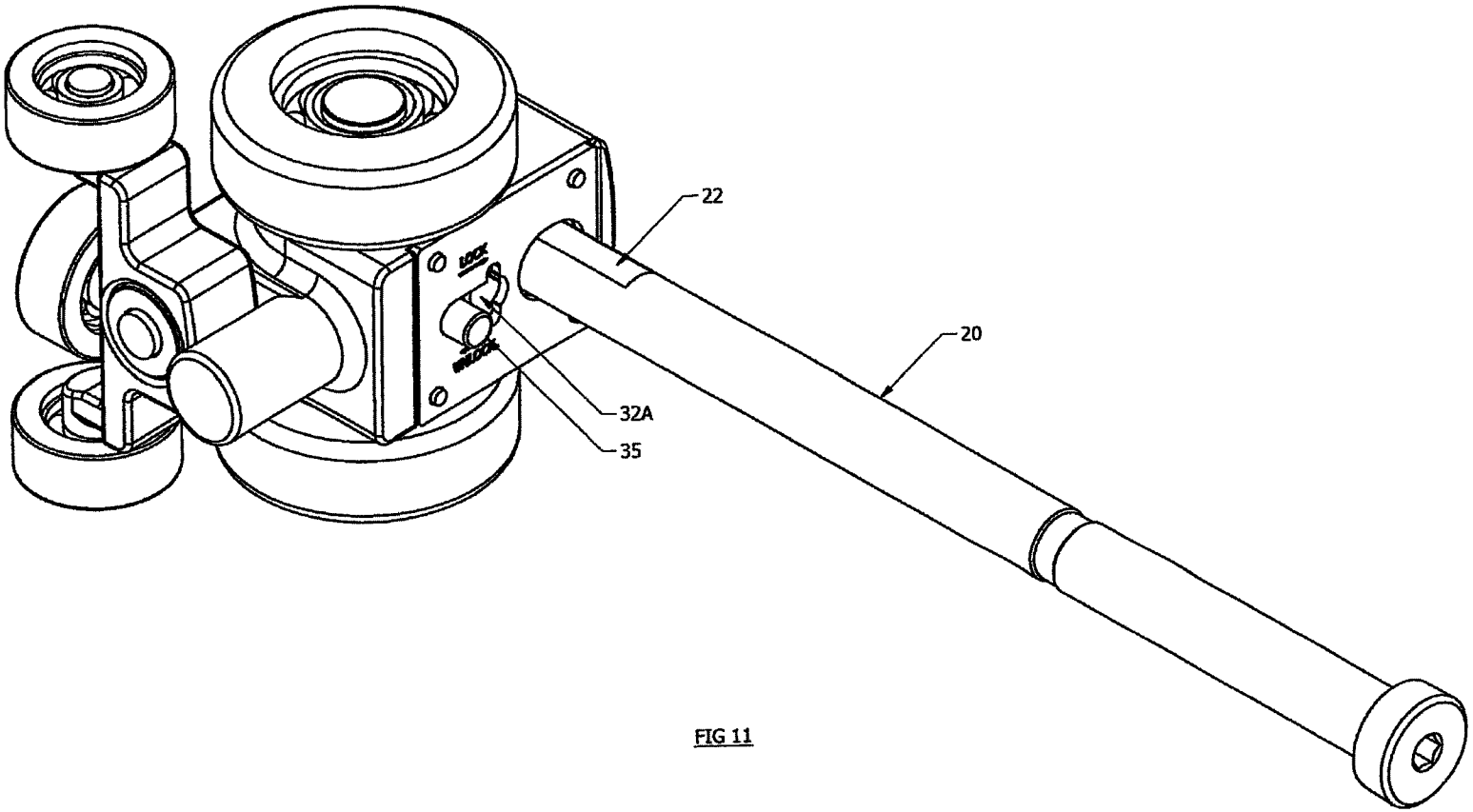
FIG. 11 is a perspective view of the position of the hanger bolt prior to locking.
Figure 12:
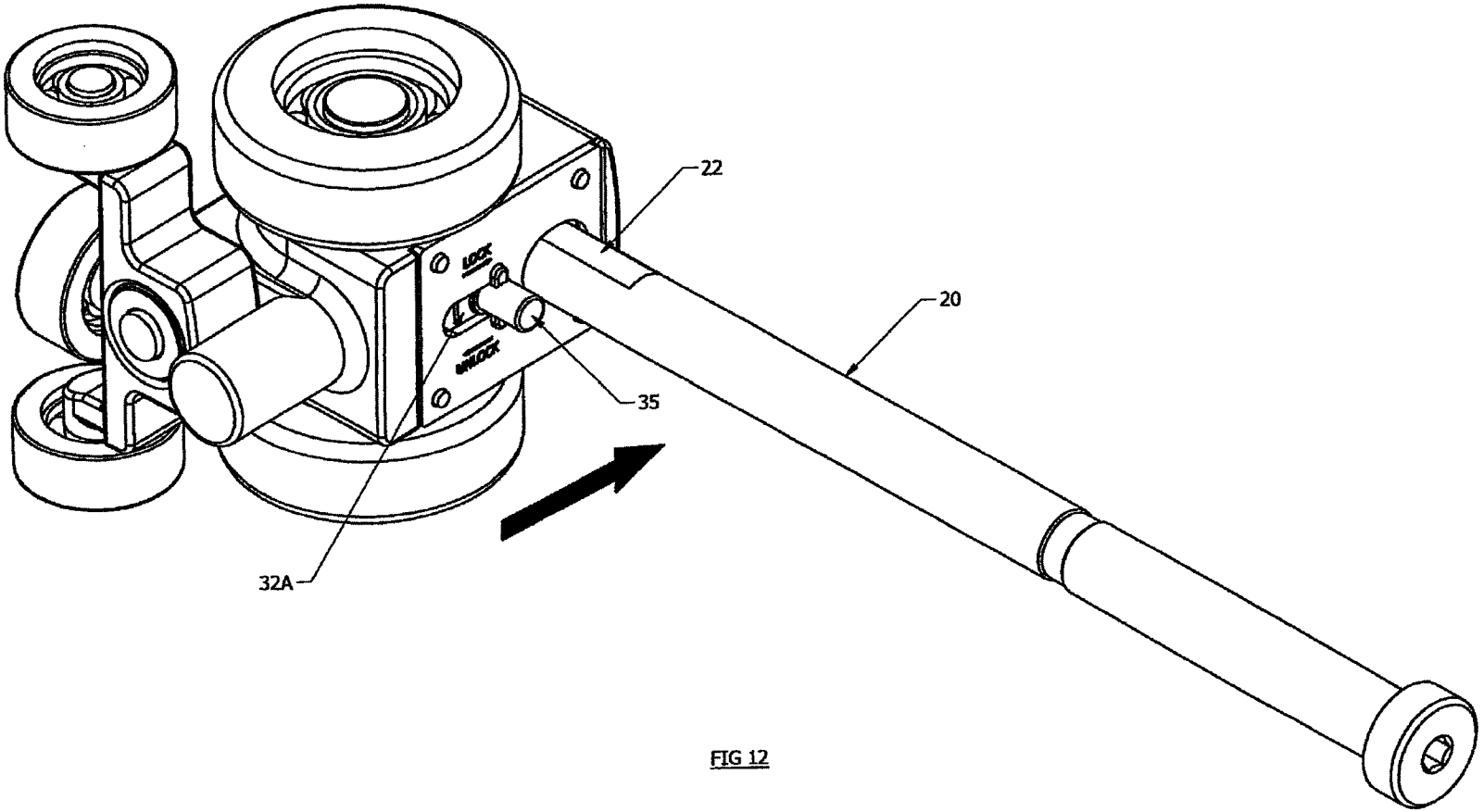
FIG. 12 is illustrates the lock mechanism being re-engaged.

When the correct adjustment has been made the hanger bolt 20 is rotated slightly so that the flats 22 are aligned with the surfaces 34 of the keeper 32A as illustrated in FIG. 11. From that position, the button 35 is slid back to the original position, as shown in FIG. 12, so that the keeper 32A engages the flats 22 to secure the hanger bolt 20 against any further rotation relative to the bogey assembly 1.

Figure 13:
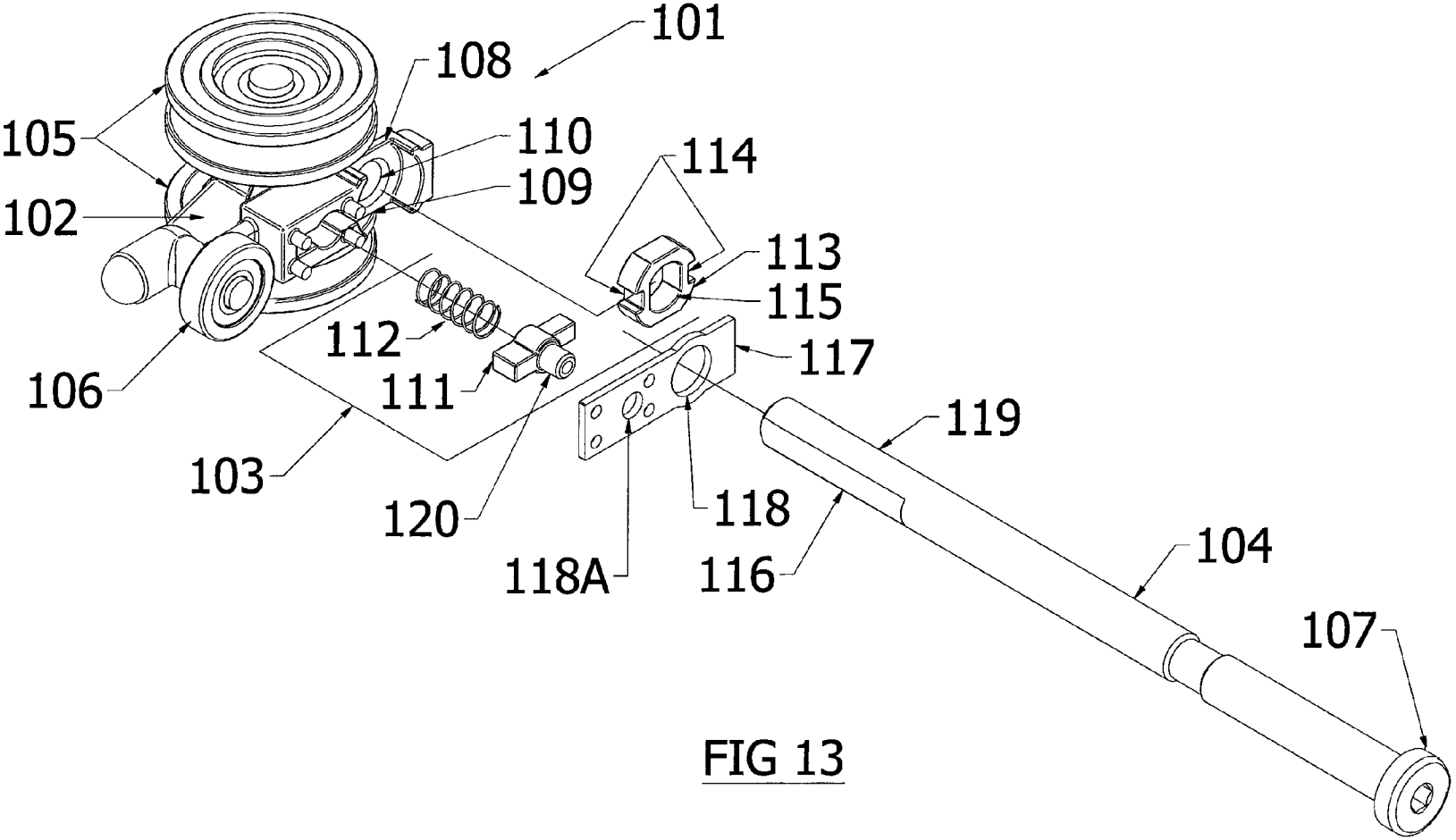
FIG. 13 is an exploded perspective view of another example of a bogey assembly and hanger bolt.

Another example of a bogey assembly 101 is shown in FIGS. 13 to 17. Referring to FIG. 13 the bogey assembly 101 is shown as including a body 102 with a lock mechanism 103 arranged to engage a hanger bolt 104.

The body 102 is provided with wheels 105 and rollers 106 for guiding the assembly in an overhead track (not shown) and the lock mechanism 103 serves to fix the hanger bolt 104 in the bogey assembly 101 to thereby lock the bolt head 107 and supported door panel at an appropriate height relative to the track.

The body 102 is formed from a casting 108 which provides housing 109 for the lock mechanism 103. The body 102 also includes a bore 110 for receiving the hanger bolt 104.

The lock mechanism 103 includes a keeper 111 which is biased by a spring 112 into an engaged position with a locking collar 113. The locking collar 113 has an external profile with slots 114 which are engaged by the keeper 111 and an internal throat 115 profiled to engage flats 116 of the hanger bolt 104.

A cover plate 117 is provided to retain the components of the lock mechanism against the body 102. The cover plate 117 has an aperture 118 to receive a shaft 119 of the hanger bolt 104. The aperture 118 is aligned with the collar 113 so that, when the hanger bolt 104 is received in the bogey assembly 101, the flats 116 are appropriately aligned and fit within the throat 115.

The cover plate 117 also includes opening 118A, through which an actuator button 120 is accessible. The actuator button 120 is coupled to the keeper 111 and allows the keeper 111 to be moved between the engaged and free positions. When the button 120 is depressed and the 111 keeper is disengaged, the locking collar 113 is free to rotate relative to the body 102, which in turn means the hanger bolt 104 is free to rotate.

Accordingly, it may be appreciated the lock mechanism 103 provides a locked condition when the keeper 111 is the engaged condition and an unlocked condition when the keeper 111 is the free position.

Threaded engagement between an internal thread of the bore 110 and external thread on the shaft 119, causes the hanger bolt 104 to be moved in or out of the bogey assembly 101 as a result of such rotation, so as to provide height adjustment of the hanger bolt 104.

The keeper 111 is biased into the engaged position by the spring 12 so that when adjustment has been completed, the keeper 111 will automatically re-engage the collar 113, as soon as the flats 116 of the hanger bolt 104 are at right angles to the keeper 111, so that the keeper 111 can lock into one of the slots 114.

The operation of the lock mechanism 103 is now further described with reference to FIGS. 14 to 17.

Figure 14:
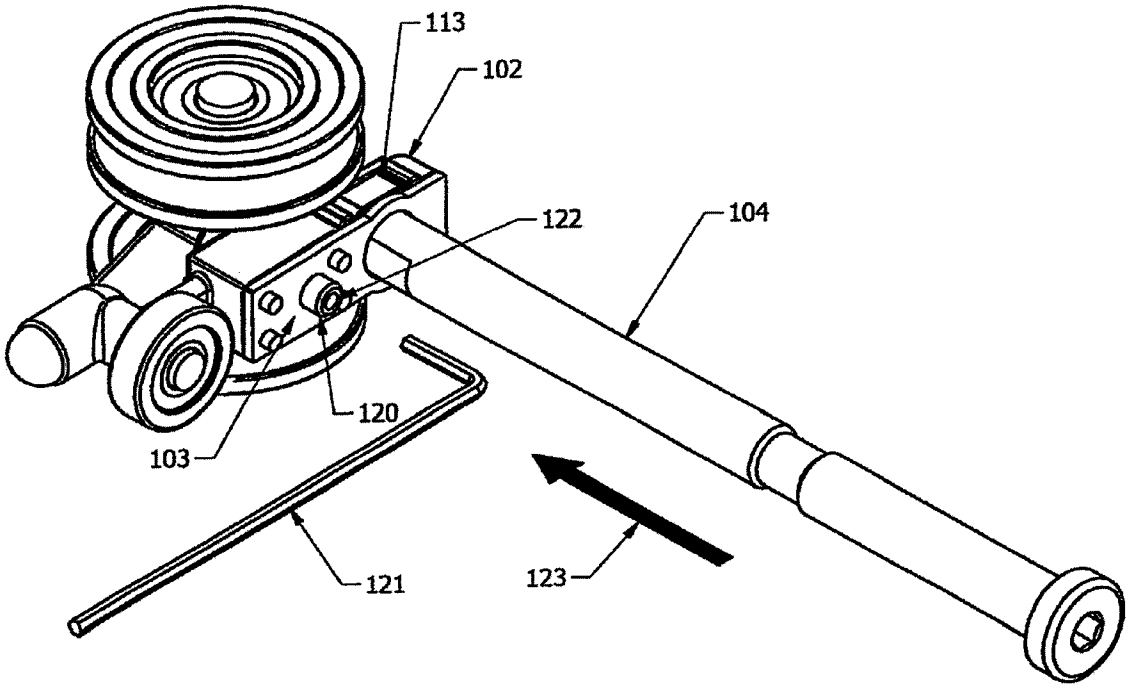
FIG. 14 is a perspective view of the bogey assembly and hanger bolt, in an assembled condition.

In FIG. 14, the lock mechanism 103 is in the locked condition, where the locking collar 113 is engaged by the keeper 111 and the hanger bolt 104 is locked against any rotation relative to the body 102 of the bogey assembly 101. In order to the free the hanger bolt 104 for rotation and height adjustment, the button 120 needs to firstly be depressed. This may be done by hand, using a finger or the like. Alternatively, a key 121 may be inserted in a recess 122 of the button, as illustrated, and pressed in a direction indicated by arrow 123.

Figure 15:
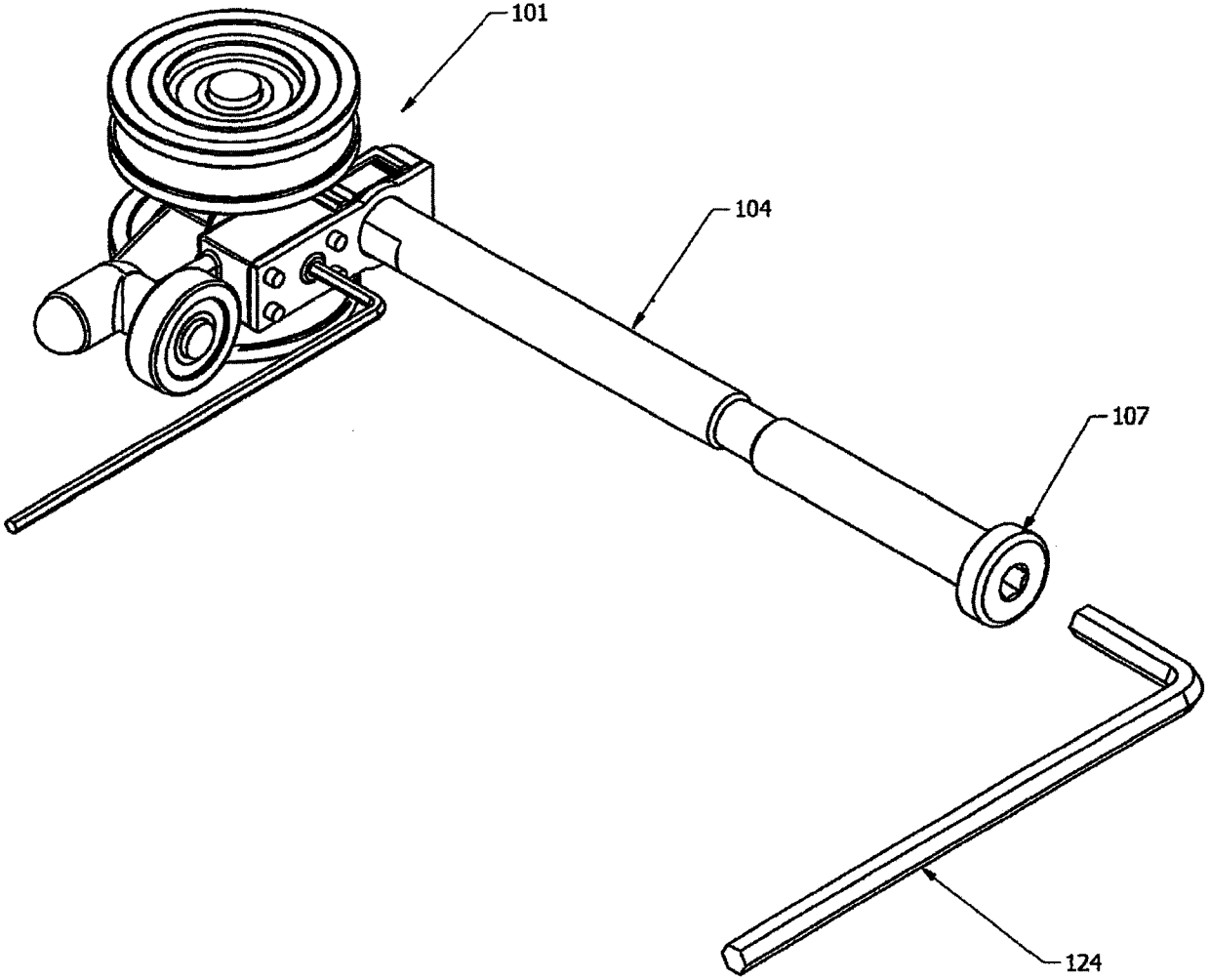
FIG. 15 illustrates a lock mechanism of the bogey assembly being freed for adjustment.

While the button 120 is pressed inwardly of the body 102, the hanger bolt 104 may be manually rotated for adjustment or a spanner key 124 can instead be inserted in the bolt head 107, as illustrated in FIG. 15.

Figure 16:
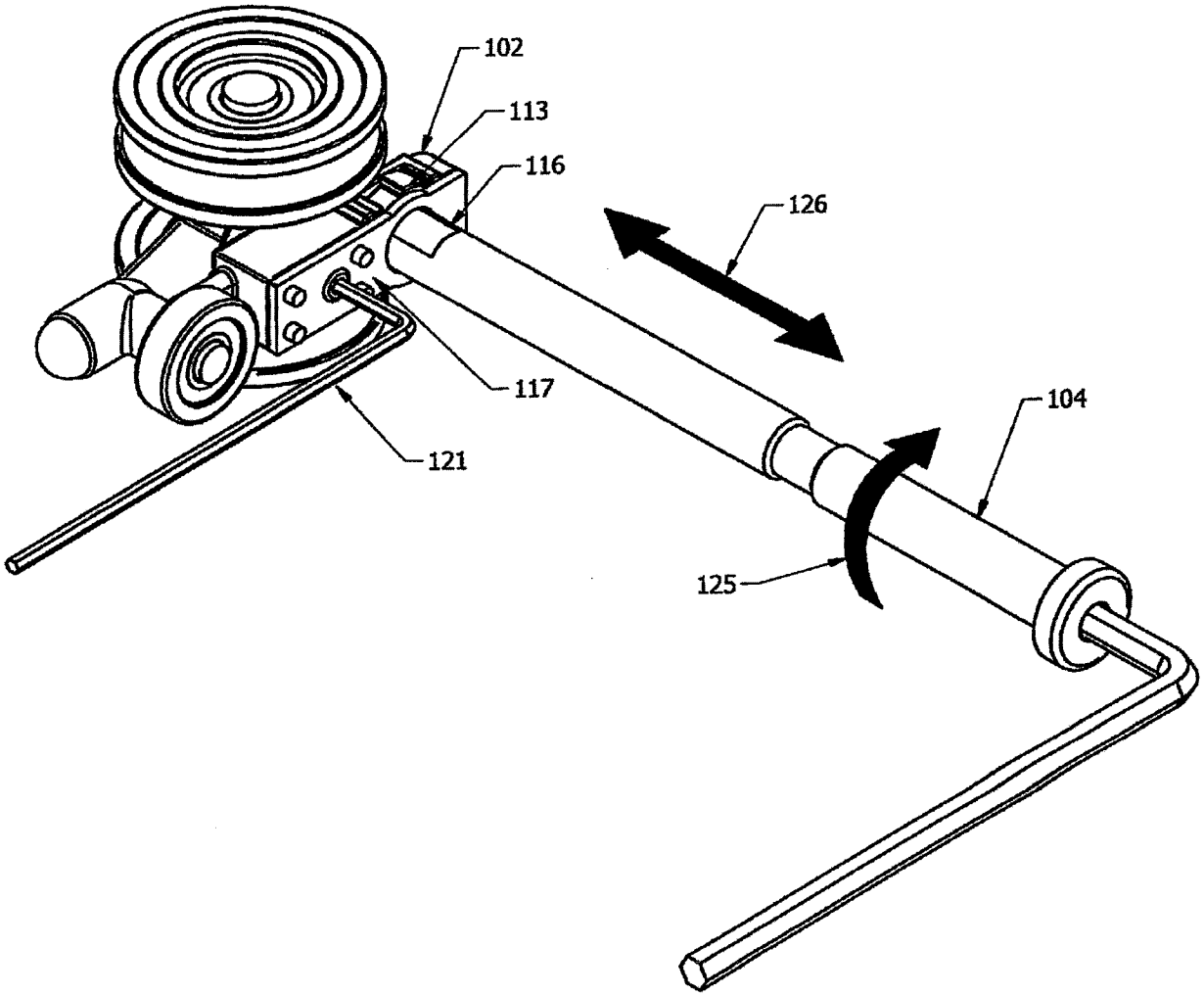
FIG. 16 illustrates adjustment of the hanger bolt.

Rotation of the hanger bolt 104, as indicated by arrow 125 in FIG. 16, will cause the hanger bolt 104 to move in an axial direction indicated by arrows 126. The axial movement of the hanger bolt 104 in and out of the body 102 adjusts the height of the door panel (not shown) supported by the bogey assembly 101. FIG. 16 also clearly shows the collar 113, which is captured between the body 102 and the cover plate 117, rotating in unison with the hanger bolt 104 since the flats 116 of the hanger bolt 104 are engaged with the inner profile of the throat 115.

Figure 17:
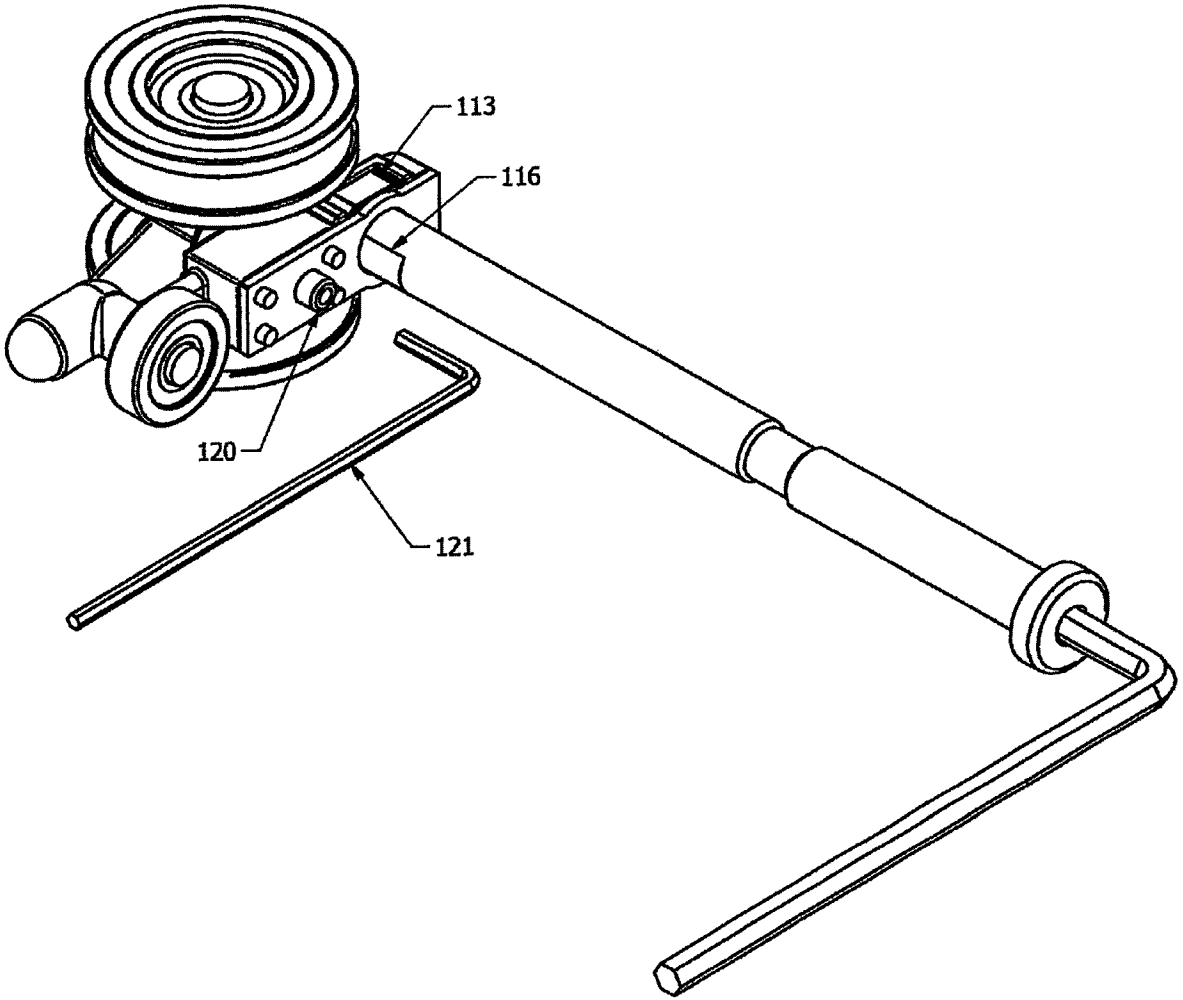
FIG. 17 illustrates the lock mechanism in an engaged condition.

When the appropriate height adjustment is obtained, the key 121 is removed, as shown in FIG. 17, which releases the button 120 so that the keeper 111 re-engages the locking collar 113, when the flats 116 are at right angles and the slots 114 re-align with the keeper 111.

As may be appreciated from the above, the lock mechanisms 32, 103 provide a convenient and simple means to securely lock the hanger bolt 20, 104 after appropriate height adjustment relative to the bogey assembly 1, 101. The lock mechanisms 32, 103 have no free parts that might otherwise be dropped or lost and can be manually disengaged for further adjustment, if required, without the need for specialised tools. The mechanisms 32, 103 are also housed within the body 4, 102 of the bogey assemblies 1, 101, to minimise aesthetic impact. Since the body assemblies 1, 101 are themselves located within an overhead track during use the entire height adjustment and lock mechanism will also be hidden from view.

The invention is now described with reference to FIGS. 18 to 25.

Figure 18:
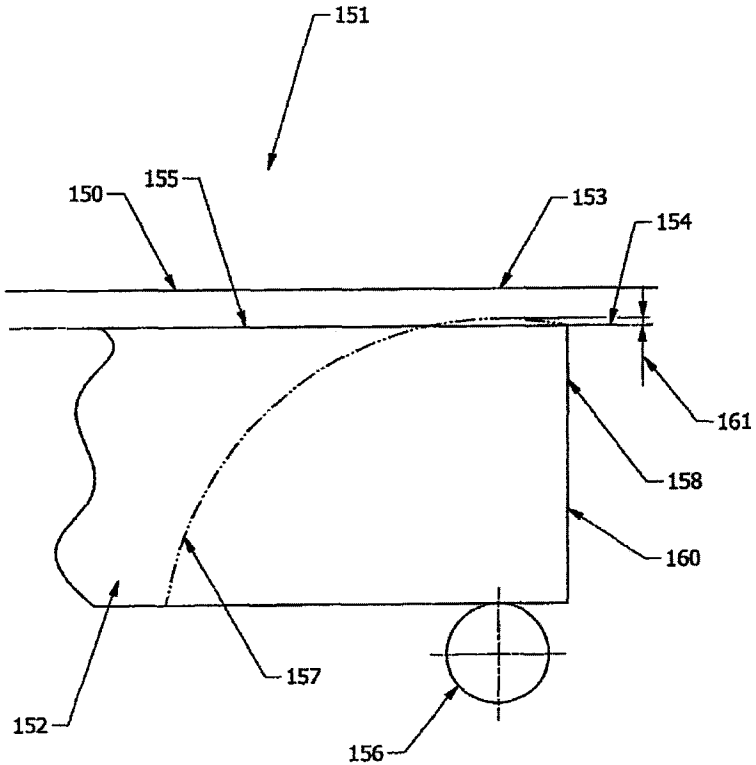
FIG. 18 is a diagrammatic plan view of part of a folding door system, illustrating an arc of a panel opening and closing.

Referring firstly to FIG. 18, a portion 151 of a folding door system 150 is shown in plan view as including a folding panel 152 and a seal timber 153 with a flexible weather seal 154, which the panel 152 is parallel to and abutting along a major face 155, when the panel 152 is in the closed position, as illustrated. The panel 152 is mounted on a vertically oriented hanger bolt 156 which is in turn connected to an overhead bogey assembly in a track (not show).

The panel 152 is hinged to the hanger bolt 156, and rotates about the bolt 156 as the panel 152 moves between closed and opened positions, while the hanger bolt travels back and forth along the track, parallel to the seal timber 153. Reference numeral 157 indicates an arc of a leading corner 158 of an edge 160 of the panel 152 as it moves into the closed position. As can be seen, there is a small distance 161 of overlap between the arc 157 and the seal 154 and this results in the corner 158 of the panel 152 pressing into the seal 154 as the panel 152 is closed. The bolt 156 is positioned as close to the edge 160 as possible to minimise the degree of overlap so that the face 155 of the panel 152 can still be reliably sealed against the seal without the leading corner 159 causing damage to the seal.

Figure 19:
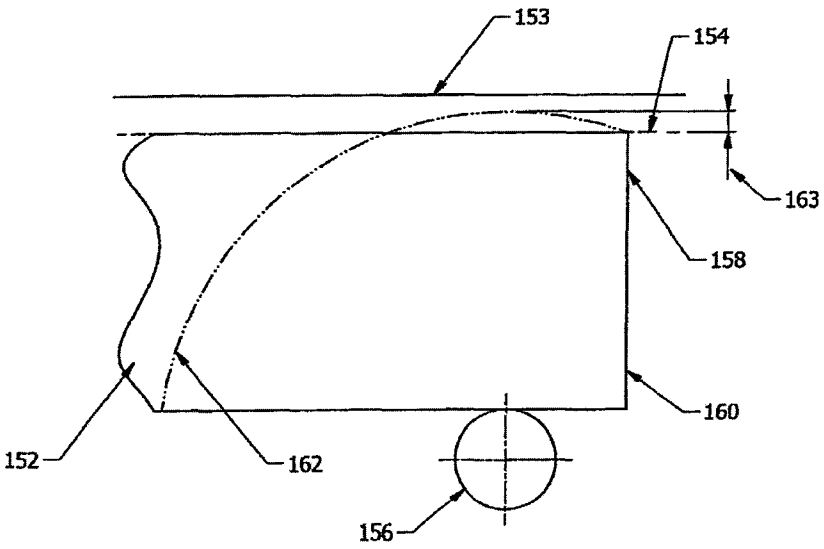
FIG. 19 is a diagrammatic plan view similar to that of FIG. 18, illustrating a different location for a hanger bolt and the resultant arc of the panel opening and closing.

For comparison, FIG. 19 shows an arc 162 travelled by the leading corner 158 if the bolt 156 was hinged to the panel 152 at a location spaced from the edge 160 of the panel 152. The distance of overlap 163 with the seal 154 is quite significant, which could cause damage as a result of the corner 159 of the panel 152 gouging the seal 154 and timber 153 as the panel is closed. As such, it is clear the hanger bolt 156 needs to be as close to the edge 160 of the panel 152 as possible.

Figure 20:
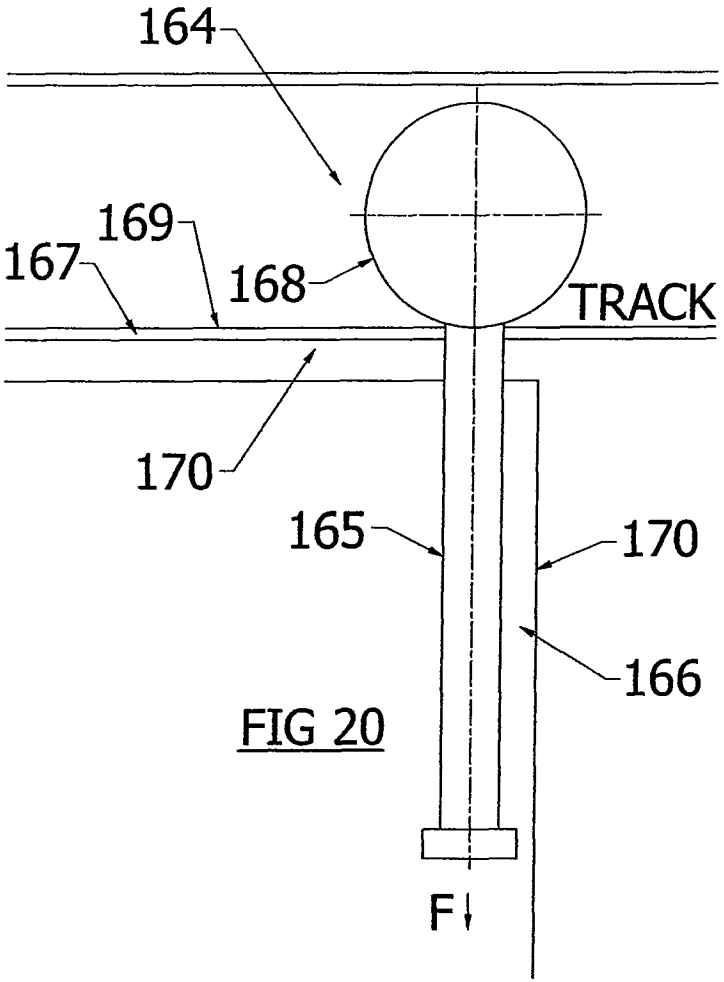
FIG. 20 is a diagrammatic side view of an end bogey assembly.

FIG. 20 schematically illustrates one form of end hanger 164 for carrying a hanger bolt 165 and attached panel 166. The end hanger 164 is mounted in an overhead track 167 and has a first, large diameter wheel 168 which is arranged to run along a rail 169 provided underneath the hanger 164 and to one side of a channel 170, through which the bolt 165 connects to the hanger 164. The bolt 165 is supported centrally of the hanger 164, directly in line and vertical with respect to the hanger 164 so that the weight load of the panel 166 can be carried by the end hanger 164 and transferred directly to the rail 169 of the track 167, without any bending moment or torque being applied from the hanger bolt 165.

To carry the weight load of the panel 166 whilst maintaining smooth operation, it is important for the wheel 168 to be of a reasonably large size. In the configuration shown, however, the wheel is past the edge 170A of the panel 166 which means the end hanger 164 will collide with, for example, a jamb before the panel 166 is closed. Similarly, in an arrangement where the edge 170A of the panel 166 is intended to close against an opposite edge of another, opposed end panel, the associated hangers will collide and prevent the panels closing.

Figure 21:
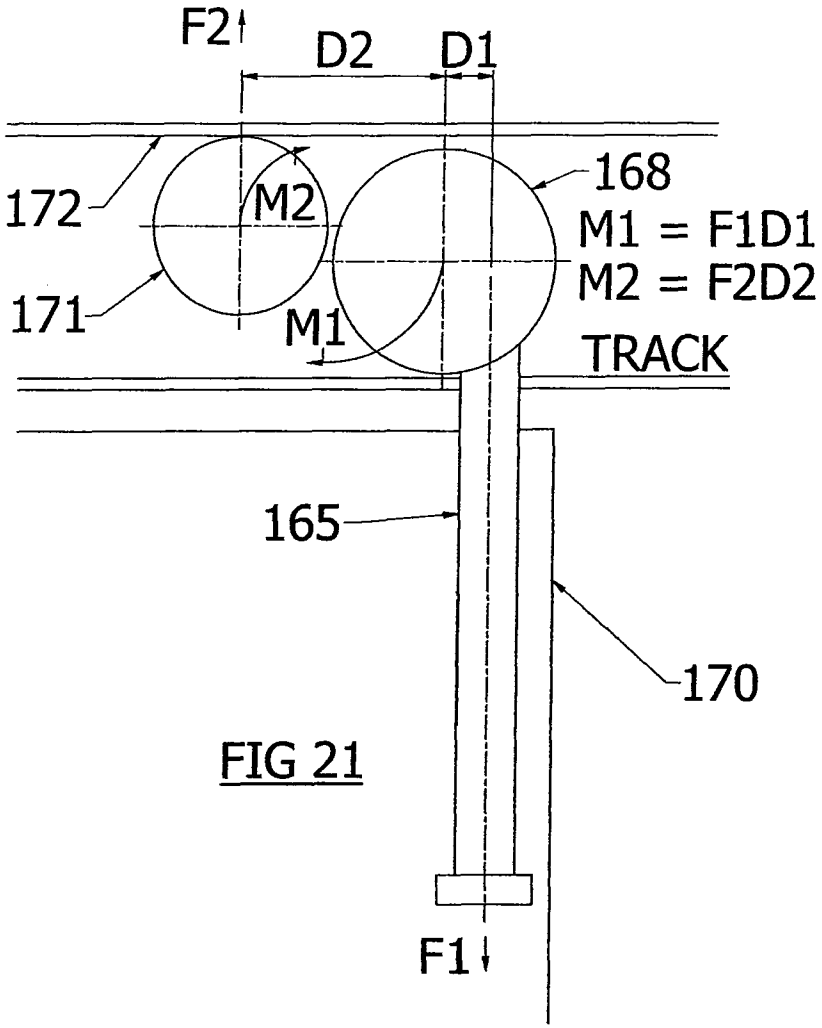
FIG. 21 is a diagrammatic side view of a cantilever bogey assembly.

To avoid the problem of collision, the wheel 168 can be offset from the hanger bolt 165, as shown in FIG. 21, which allows the wheel 168 to be set back from the edge 170A of the panel 166. However, this causes a turning or bending moment to be applied, which can lead to fatigue or failure of the hanger bolt 165 as a result of the weight load applied by the panel 166. Of course, a larger gauge bolt could be used to support a heavier panel but hardware costs would increase as a result. As an alternative, a roller 171 is provided to bear against and roll along a surface 172 above the bogey assembly, in order to counteract any turning moments. As such, relatively large diameter wheels can still be used for smooth rolling operation of the bogey assembly, while any torque resulting from the cantilevered position of the hanger bolt is counteracted by the roller 171.

Figure 22:
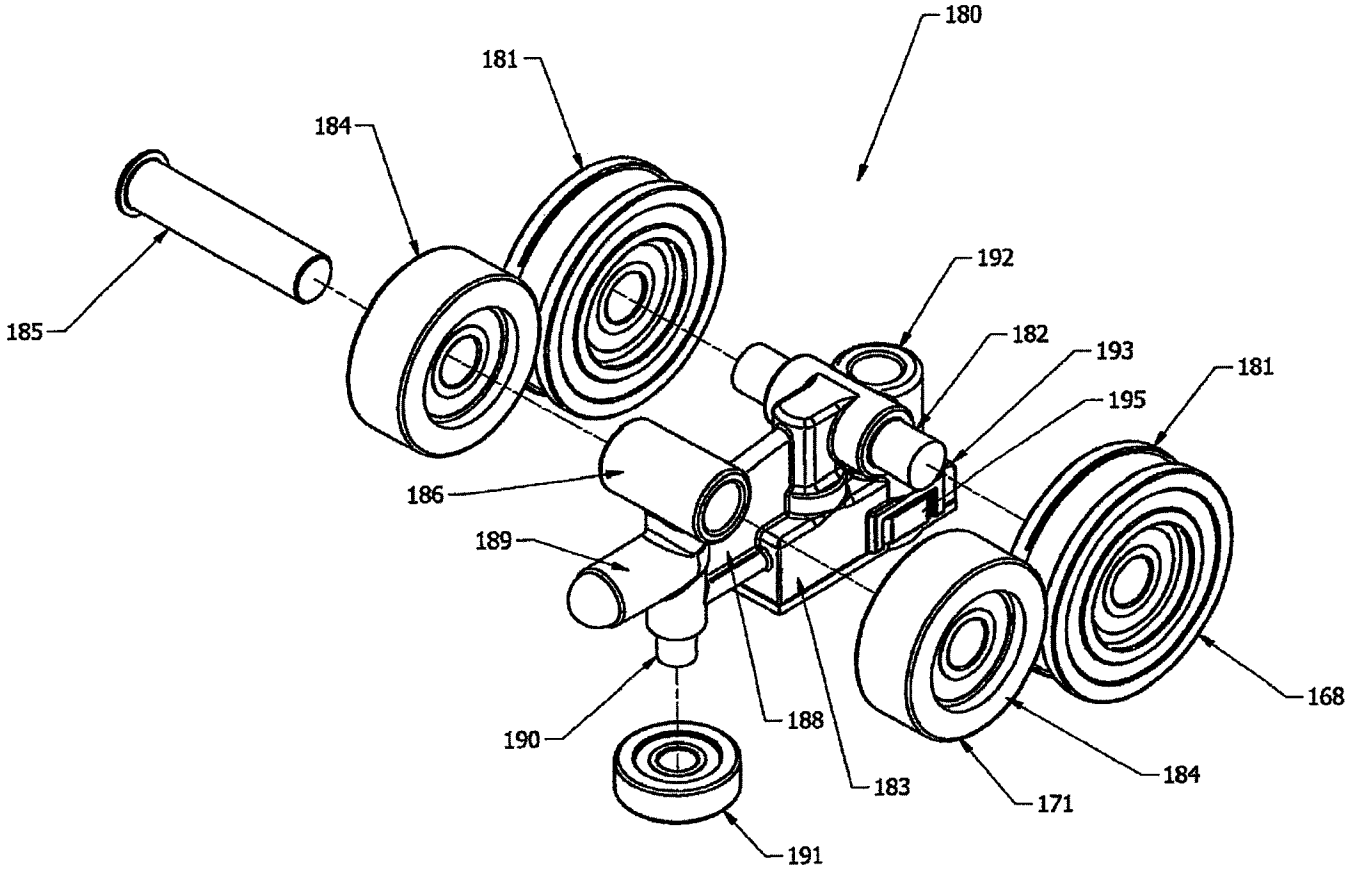
FIG. 22 is an exploded view of the bogey assembly shown in FIG. 21.

A bogey assembly 180 embodying the above principles is shown in more detail in FIG. 22, where the first wheel 168 is one of a set of wheels 181 that are carried by an axle 182 integrally moulded with a body 183 of the bogey assembly 180. The roller 171 forms one of a set of rollers 184, which are mounted on an axle 185 carried by an arm assembly 186. The arm assembly 186 is fitted to an elongate tail section 188 of the body so that the set of rollers 184 are mounted toward a first end 189 of the bogey assembly, in an elevated position relative to the set of wheels 181.

Figure 24:
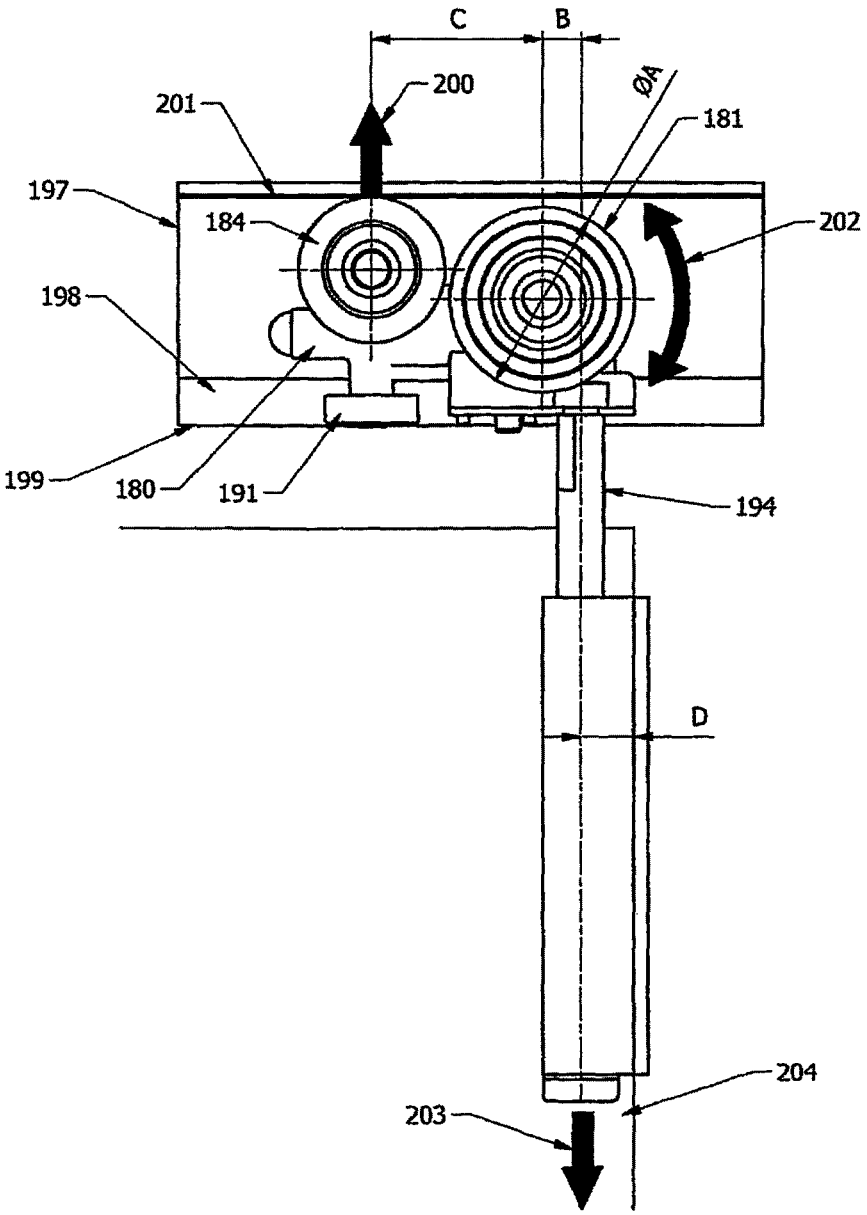
FIG. 24 is a diagrammatic side view of the bogey assembly of FIG. 23 supporting a panel from an overhead track.

The body 183 is formed with a depending boss 190, which carries a guide roller 191 and a retainer 192 at a second end 193 of the bogey assembly 180 for receiving a hanger bolt 194 (shown in FIG. 24). A lock mechanism 195, formed in accordance with, for example, any one of lock mechanisms described with reference to FIGS. 5 to 17, is also provided to lock the bolt against rotation relative to the body 183.

Figure 23:
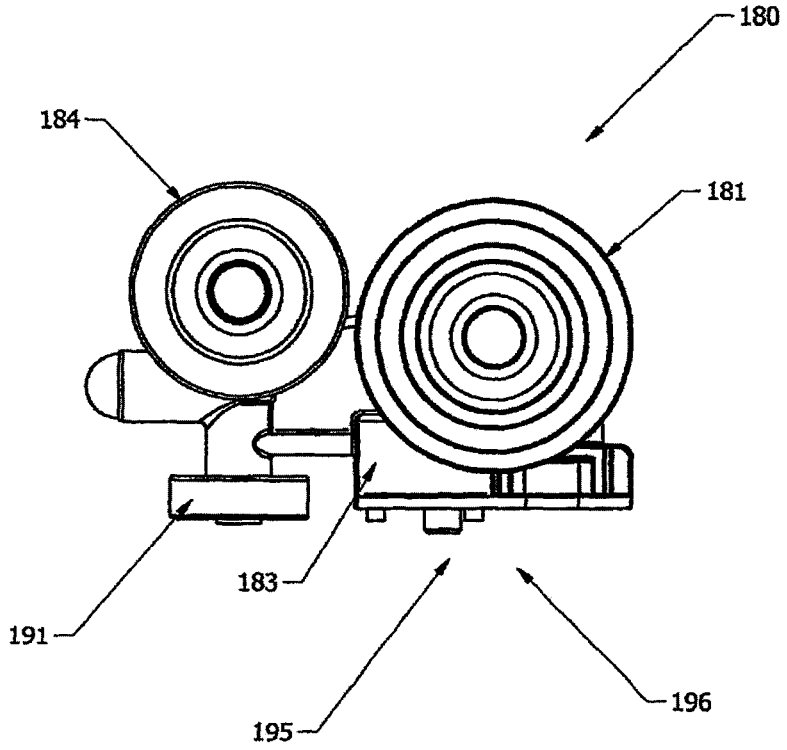
FIG. 23 is a side view of the bogey assembly of FIG. 22, shown in an assembled condition.

Referring now to FIG. 23, the assembled bogey assembly 180 is shown in profile, with the lock mechanism 195 and guide roller 191 positioned at the underside 196 of the body 183 and the set of rollers 184 being offset relative to the set of wheels 181, lengthwise of the body 183 and vertically.

The bogey assembly 180 is shown mounted in a track 197 in FIG. 24, where the set of wheels 181 are positioned to roll on top of rails 198, either side of channel 199 and the guide roller 191 is positioned between the rails 198 to provide lateral stability and guide the bogey assembly along the track 197.

In that configuration, the set of rollers 184 are biased (as indicated by force 200) against an internal, underside 201 of the track 197, above the bogey assembly 180, to counteract rotational forces (indicated by arrow 202) on the cantilevered hanger bolt 194 caused by the weight load (indicated by arrow 203) of panel 204.

The attachment of the bolt 194 to the bogey assembly 180 is different to the live axle attachment described with reference to the bogey assemblies of FIGS. 1 to 17. In this case, the retainer 192 is fixed relative to the body 183, such as by being integrally moulded. As such, when the bolt 194 is screwed into the retainer 192 substantially rigid connection is formed between the bolt 194 and the body 183. As a result, any turning moments are transmitted directly through the solid structure of the body 183, which provides a robust mechanism for force transmission.

The rigid connection of the bolt 194 with the bogey assembly 180, coupled with the set of rollers 184 acting to resist rotation of the body 183 away from the rails, means that rotational forces on the hanger bolt 194 are counterbalanced, which substantially reduces bending forces on the bolt 194 itself. As such, the hanger bolt 194 is able to carry heavier panels.

Figure 25:
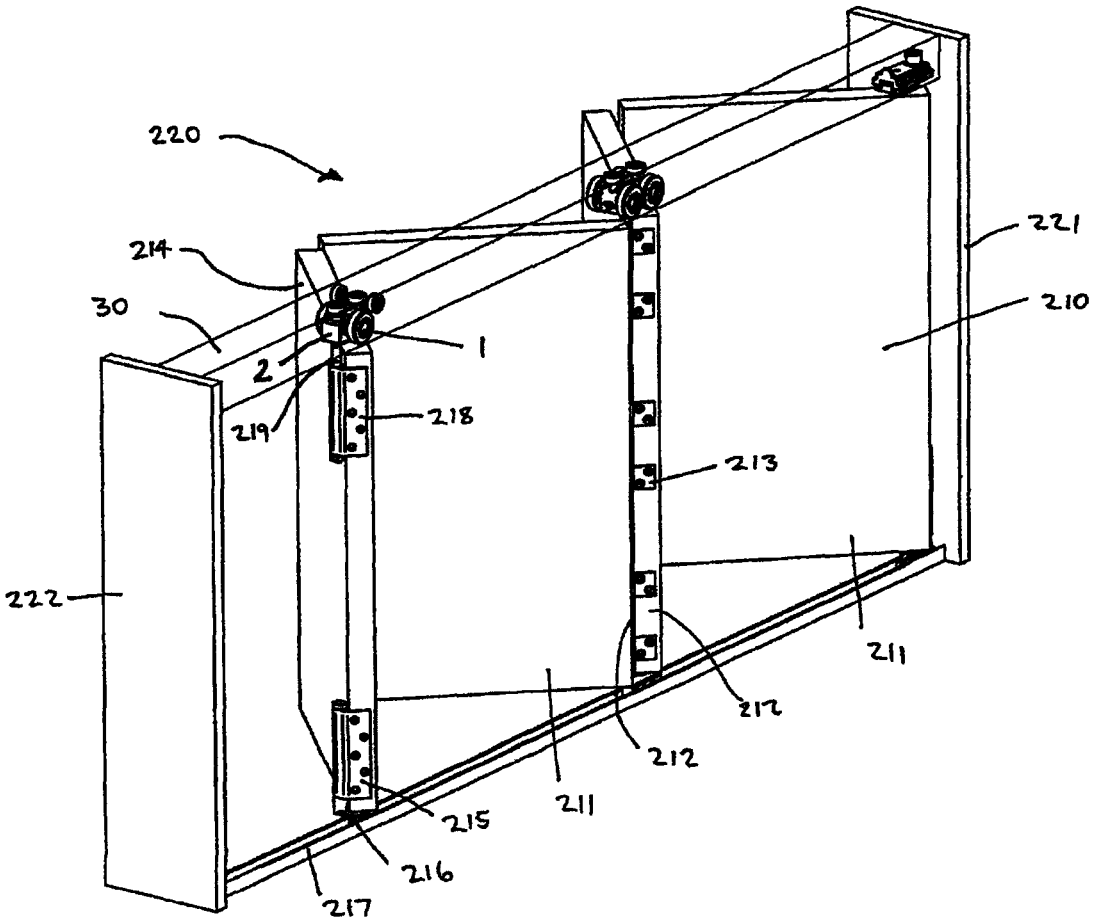
FIG. 25 is a perspective view of a folding door system.

Referring now to FIG. 25, a folding panel assembly 210 is shown mounted in a folding door system 220. The panel assembly 210 includes multiple folding panels 211 which are coupled together at adjacent edges 212 by hinges 213. An end panel 214 is mounted in the system 220 by way of a bottom hinge 215 connected to a guide 216, which runs in a bottom track 217. An upper hinge 218 is connected to a hanger bolt 219 which is received in a bogey assembly 1, as described above. The bogey assembly 1 is carried in an overhead track 30, which forms part of the overall system 220.

The system 220 includes the panel assembly 210, as well as the bottom track 217, overhead track 30 and jambs 221 and 222. It will be appreciated the use of a bogey assembly 1 allows the end panel 214 to close snugly against the jamb 222 for reliable sealing without gouging, due to the cantilevered position of the bolt 219 relative to the body 2 of the bogey assembly 1.

It should be noted the invention has been described with reference to supporting a folding panel, however, the bogey assembly is equally applicable to supporting any other type of panel such as a sliding door or the like.

Many modifications will be apparent to those skilled in the art without departing from the scope of the present invention.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

LIST OF PARTS

1. Bogey assembly
2. Body
3. Wheels
4. Axles
5. Rollers
6. Pivot arm assembly
7. Lateral sections
8. Axle
9. First end
10. Washer
11. Boss
12. Buffer
13. Guide roller
14. Second guide roller
15. Second end
16. Retainer
17. Axle

18. Passage
19. Internal thread
20. Hanger bolt
21. Shaft
22. Side flats
23. Bolt head
24. Hinge
25. Arrows
26. Arrow
27. Arrow
30. Track
30A. Top rail section
30B. Bottom rail section
30C. Slot
30D. Channel
31. Housing
32. Lock mechanism
32A. Keeper
33. Block
34. Flat surfaces
35. Button
36. Spring
37. Base
38. Bore
39. Neck
39A. Cover plate
40. Aperture
41. Arrow
42. Shoulders
43. Arrow
44. Arrows
45. Arrows
101. Bogey assembly
102. Body
103. Lock mechanism
104. Hanger bolt
105. Wheels
106. Rollers
107. Bolt head
108. Casting
109. Housing
110. Bore
111. Keeper
112. Spring
113. Locking collar
114. Slots
115. Throat
116. Flats
117. Cover plate
118. Aperture
118A. Opening
119. Shaft
120. Actuator button
121. Key
122. Recess
123. Arrow
124. Spanner key
125. Arrow
126. Arrow
150. Folding door system
151. Portion
152. Folding panel
153. Seal timber
154. Seal
155. Face
156. Hanger bolt
157. Arc
158. Corner
159. Corner
160. Edge
161. Distance
162. Arc
163. Overlap
164. End hander
165. Hanger bolt
166. Panel
167. Track
168. Wheel
169. Rail
170. Channel
170A. Edge
171. Roller
172. Surface
180. Bogey assembly
181. Wheels
182. Axle
183. Body
184. Rollers
185. Axle
186. Arm assembly
188. Tail section
189. First end
190. Boss
191. Guide roller
192. Retainer
193. Second end
194. Hanger bolt
195. Lock mechanism
196. Underside
197. Track
198. Rails
199. Channel
200. Force
201. Underside
202. Arrow
203. Arrow
204. Panel
210. Panel assembly
211. Folding panel
212. Edge
213. Hinge
214. End panel
215. Bottom hinge
216. Guide
217. Bottom track
218. Upper hinge
219. Hanger bolt
220. Folding panel system
221. Jamb
222. Jamb

The invention claimed is:

1. A bogey with a body having only a single set of support wheels and a bore positioned in-line with a center line of the body and laterally offset to an axis of the wheels, the bore configured to receive a hanger bolt in a cantilevered position relative to the wheels, the bore having an internal thread for engagement with a threaded upper end of the hanger bolt to allow the hanger bolt to be rotated relative to the body for height adjustment, wherein the body further includes a housing in a base of the body that receives a lock mechanism to selectively secure the hanger bolt against rotation by engaging side flats of the hanger bolt, and a cover plate that captures the lock mechanism in the housing.

2. The bogey of claim 1, wherein the cover plate defines an aperture such that the hanger bolt passes through the cover plate and into the bore, the lock mechanism including a keeper arranged to move between a free position in which the bolt is free to rotate and an engaged position where the flats of the hanger bolt are locked against rotation, and wherein the cover plate further defines an opening for an actuator to operate the lock mechanism and move the keeper between the free and engaged positions.

3. The bogey of claim 2, wherein the keeper is moved into the engaged position by sliding laterally through the housing and into engagement with the side flats of the hanger bolt.

4. The bogey of claim 2, wherein the lock mechanism includes a collar that is fitted to the flats of the bolt and the keeper engages and locks against the collar to restrict relative rotation of the bolt.

5. The bogey of claim 4, wherein the collar includes a slotted profile, in to which the keeper is moved to engage and lock the collar and bolt against rotation.

6. The bogey of claim 5, wherein the keeper is retained in an engaged position under bias.

7. The bogey of claim 6, wherein the lock mechanism includes an actuator button to move the keeper between a free position and the engaged position.

8. The bogey of claim 7, wherein the lock mechanism has a cover plate to capture the keeper in a housing in a base of the body and the button projects through the plate.

9. The bogey of claim 2, in combination with the threaded hanger bolt that is screw threaded into the retainer, the bolt having side flats for the lock mechanism to engage, to restrict relative rotation between the bolt and the retainer.

10. A panel assembly including the bogey of claim 1, an end panel supported by the bogey and a hanger bolt interconnecting the end panel and the bogey.

11. A folding door system, including a frame with a jamb and an overhead track, a folding panel assembly mounted in the frame and the bogey of claim 1, wherein an end panel of the folding panel assembly is mounted to the overhead track via the hanger bolt of the bogey.

12. The folding door system of claim 11, wherein the bogey travels above the panel through the track as the panel is opened and closed and wherein the body of the bogey holds the hanger bolt in a cantilevered position adjacent the jamb when the panel is closed, while the supporting wheels are positioned in spaced relation from the jamb so as to enable an edge of the end panel to substantially close against the jamb without obstruction from the wheels.

* * * * *